United States Patent [19]

Rinehart

[11] 4,000,524

[45] Jan. 4, 1977

[54] ARTICULATED GLOVE CONSTRUCTION

[75] Inventor: Dixie L. Rinehart, Aspen, Colo.

[73] Assignee: Comfort Products, Inc., Aspen, Colo.

[22] Filed: Aug. 14, 1975

[21] Appl. No.: 604,711

[52] U.S. Cl. ..... 2/161 R
[51] Int. Cl.[2] ..... A41D 19/00
[58] Field of Search ..... 2/16, 158, 159, 160, 2/161 R, 161 A, 167, 164, 169

[56] References Cited

UNITED STATES PATENTS 2,285,538 6/1942 Simon ..... 2/164

*Primary Examiner*—G.V. Larkin
*Attorney, Agent, or Firm*—Pennie & Edmonds

[57] ABSTRACT

A glove construction patterned to be conformal to the articulated movements of the human hand where a plurality of individual parts are designed and constructed to accommodate controlled extension and compression of the outer cover with respect to finger, thumb and metacarpal joints. The finger portions are provided with telescoping sections terminating at the lateral sides of the fingers on a neutral line of the finger joint called "the line of non-extension." The thumb back is comprised of three sections which form a natural thumb contour in the normal working attitude. The finger sections join the hand portion of the glove to provide a natural break line for the palm and metacarpal joints.

An outer leather lining for a glove is provided with the inwardly facing surface of the lining having a water impermeable film bonded thereto.

5 Claims, 9 Drawing Figures

ARTICULATED GLOVE CONSTRUCTION

BACKGROUND OF THE INVENTION

A difficulty of conventional glove constructions, and particularly gloves which are adapted for use in extreme temperature conditions, is that they are often bulky and non-conformal to the complete movement of the human hand resulting in loss of mobility, tactility and dexterity of the wearer. Further such gloves often cause compression of insulation material along fold lines thus reducing the insulation effectiveness of the glove.

A further difficulty with conventional gloves, and particularly those subjected to damp conditions, for example ski gloves, is to provide an outer lining surface capable of breathing in the manner of natural leather and at the same time, prevent the passage of moisture to the interior of the glove.

It is, therefore, an object of my invention to provide for a glove construction which will conform to the natural movement of the fingers and particularly of the thumb of the wearer. It is a further object of my invention to provide for a leather outer lining of a glove that will breathe in the manner of natural leather and at the same time be impermeable to water. In addition a further object is to provide a moisture barrier which is not exposed to abrasion and wear by placing the barrier on the inside of the glove cover.

GENERAL DESCRIPTION OF THE INVENTION

Broadly, my invention comprises a glove construction wherein the outer cover of the glove is made up of individual sections in order that the movement of the finger and thumb portions will correspond to the normal movement of the fingers and thumb of the wearer. The outer cover comprises a gauntlet portion having an aperture therein through which the thumb of the wearer is adapted to penetrate and a metacarpal thumb portion which is connected to the gauntlet along a part of the circumference of the aperture. A first phalanx portion is connected to the metacarpal portion and is also connected to the gauntlet along a further part of the circumference of the aperture. A second phalanx portion is connected at one end to the end of the first phalanx portion opposite the aperture in the gauntlet portion. A front portion is connected at one end to the gauntlet along a still further part of the circumference of the aperture and at its opposite end to the second phalanx portion so as to extend along the length of the front of the thumb of the wearer. By this construction, the junctions of the several portions making up the thumb portion occur along the normal joint lines of the thumb assuring that the outer cover of the thumb is contoured and conformed to the normal "work profile" of the thumb during grasping and/or manipulation. The thumb portion preferably has an abrasive portion extending over a part of the front portion and portions of the first and second phalanxes to provide a wear surface on the area of the thumb portion most susceptible to abrasion.

In addition, each finger portion of the outer cover comprises a front and back finger portion each joined at one end to the gauntlet. The outer surface of each back portion is pleated across the width thereof to provide a plurality of telescoping sections so that the back portion may effectively extend when the fingers are flexed. The telescopic sections are constructed such as to terminate at the lateral sides of each finger on a line of non-extension so that each finger cover follows natural extension and compression of the finger maintaining finger tip contact and providing for natural tactility and dexterity during hand grasping and finger manipulation.

Preferably, the glove construction may have an outer lining comprising a leather-like material which is capable of breathing in the manner of conventional leather. The inwardly facing surface of the lining is treated with an elastomeric material in order to provide a moisture-impermeable film which is bonded to the lining to give a degree of waterproofing to the glove.

DESCRIPTION OF THE PREFERRED EMBODIMENTS

Figure 1:
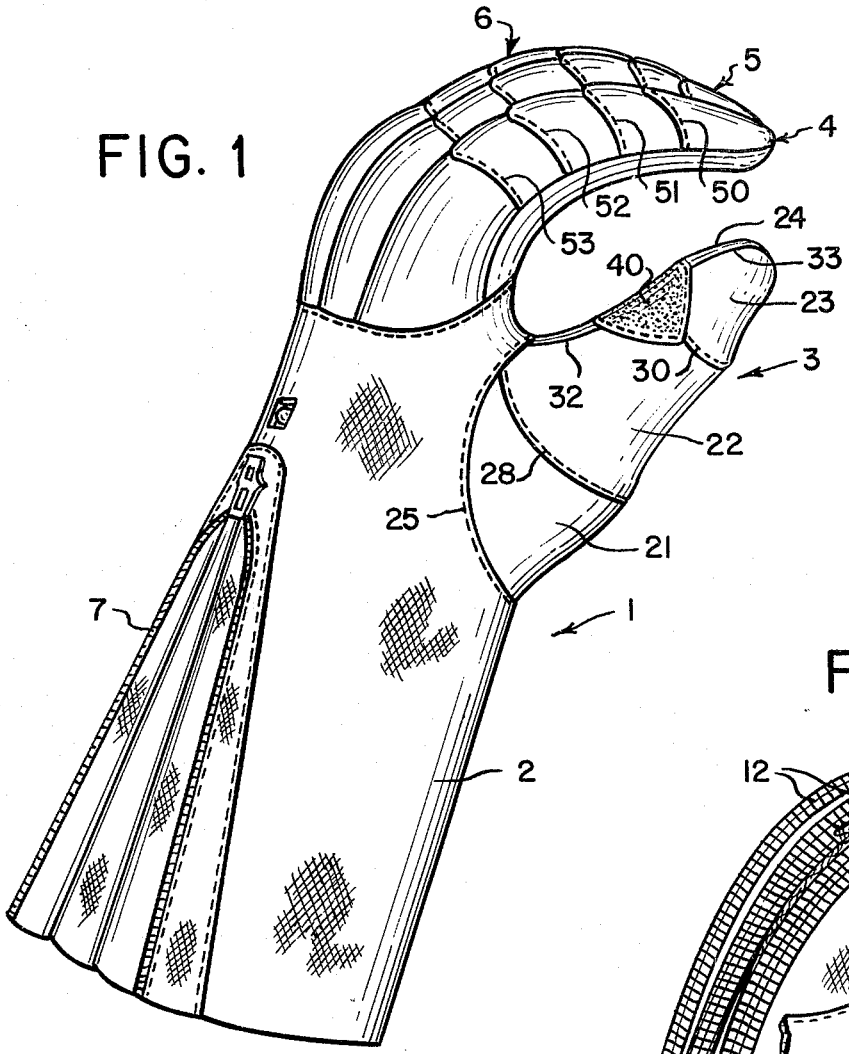
FIG. 1 is a side view of a glove constructed according to the invention.

Referring to the drawings, and particularly to FIG. 1, there is illustrated a glove 1 constructed according to the invention having an outer cover comprising a qauntlet portion 2, a thumb portion 3 and finger portions 4, 5 and 6, the last or little finger portion not being illustrated. The gauntlet portion 2 has a zipper 7 by which the glove may be securely fastened to the lower arm of the wearer.

Figure 2:
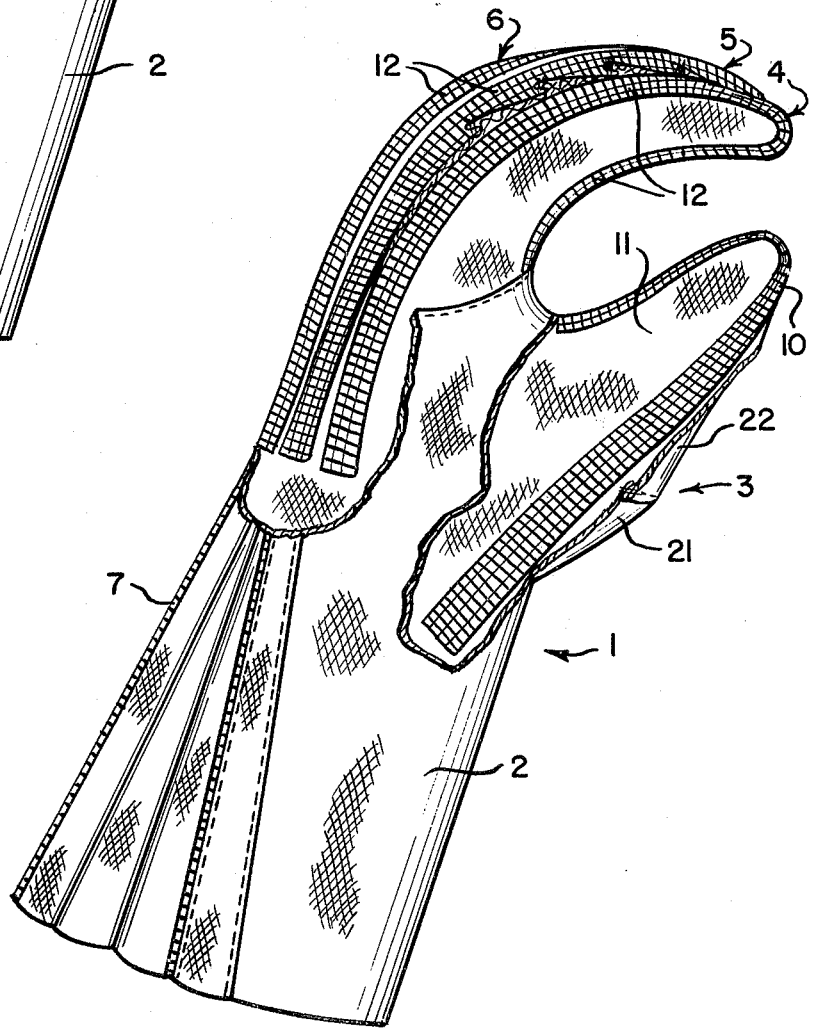
FIG. 2 is a partial sectional view of the glove of FIG. 1 illustrating placement of insulative strips in the thumb and finger portions of the glove.

The glove of FIG. 1 may, as shown in FIG. 2, include insulation strips to provide protection to the wearer against extreme temperature conditions. The strips, because of their thickness add to the massiveness of the glove and when included in conventional constructions, would tend to impede movement of the thumb and finger portions. As shown, the insulation strip 10 is mounted on a cloth inner lining 11 and extends along the length of the front of the thumb, over the end and then along the length of the back of the thumb. Similarly, the strip 12 is mounted on the cloth inner lining and extends along the length of the front of the finger, around the tip thereof and then along the length of the back of the finger. The remaining finger portions have similar strips mounted in the same manner as the strip 12.

Figure 3:
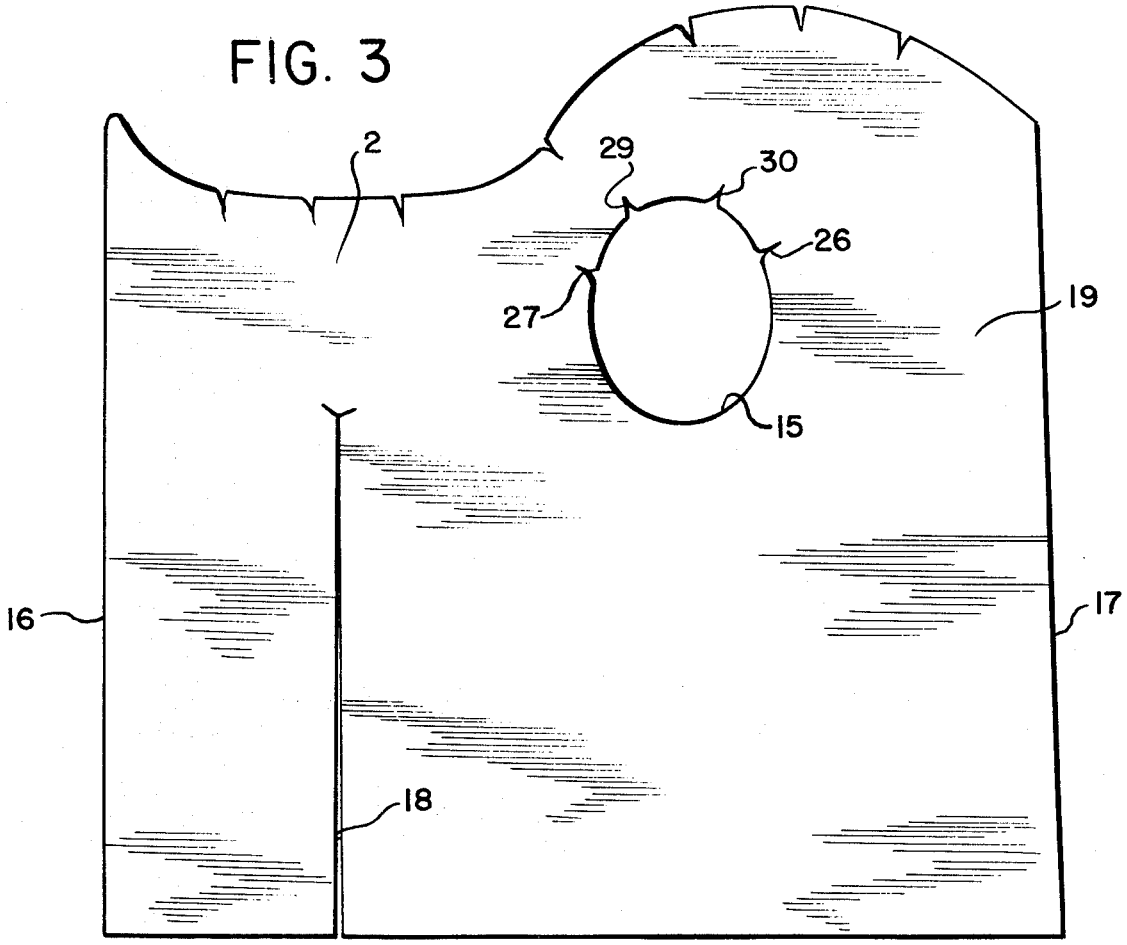
FIG. 3 is a plan view of the pattern of the gauntlet portion of the glove of FIG. 1.

The gauntlet portion 2 as shown in pattern form in FIG. 3 has an aperture 15 therein through which the thumb of the wearer is adapted to penetrate. The gauntlet portion would be sewn together along its edges 16 and 17 with the slit 18 providing accommodation for the zipper 7. When edges 16 and 17 are sewn together, the qauntlet portion forms a surface adapted to surround the wrist of the wearer as well as forming a palm area 19 adapted to cover the palm of the wearer.

Figure 6:
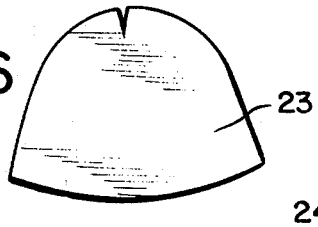
FIG. 6 is a plan view of the pattern of the second phalanx portion of the glove of FIG. 1.
Figure 7:
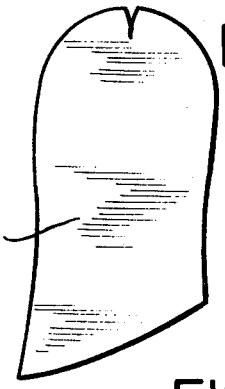
FIG. 7 is a plan view of the pattern of the front thumb portion of the glove of FIG. 1.
Figure 5:
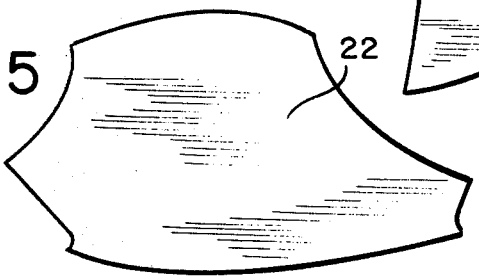
FIG. 5 is a plan view of the pattern of the first phalanx portion of the glove of FIG. 1.
Figure 4:
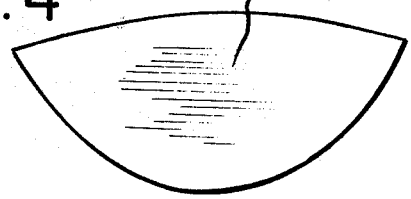
FIG. 4 is a plan view of the pattern of the metacarpal portion of the glove of FIG. 1.

The articulated thumb portion 3 of the glove comprises a metacarpal portion 21 shown in FIG. 4, a first phalanx portion 22 shown in FIG. 5, a second phalanx portion 23 shown in FIG. 6 and a front portion 24 shown in FIG. 7.

The metacarpal portion 21 is joined to the gauntlet 2 by stitching along seam 25 as shown in FIG. 1 around the portion of the circumference of the aperture 15 extending from points 26 and 27 as shown in FIG. 3. The first phalanx portion 22 is joined to the metacarpal portion by stitching along the seam 28 and also to the gauntlet portion around the part of the circumference of the aperture 15 between points 27 and 29 and 26 and 30. The second phalanx portion 23 which is adapted to cover the thumbnail of the wearer is sewn to the first phalanx portion along the seam 30. The front portion 24 is sewn to the gauntlet between the points 29 and 30 on the circumference of the aperture, to the first phalanx along the seam 32 and to the second phalanx along the seam 33.

As shown in FIG. 1, the individual portions making up the thumb portion are joined to each other and to the gauntlet so that the junctures occur along the joints of the bones of the thumb of the wearer with the result that the parts may flex with respect to each other along the joint whereby the thumb portion of the glove will have the same degree of movement as the thumb of the wearer.

If desired, an abrasive portion 40 may be sewn onto the second and third phalanx so as to extend over the front portion 24 to provide extra protection against abrasion to that part of the thumb portion most subjected to wear.

Figure 9:
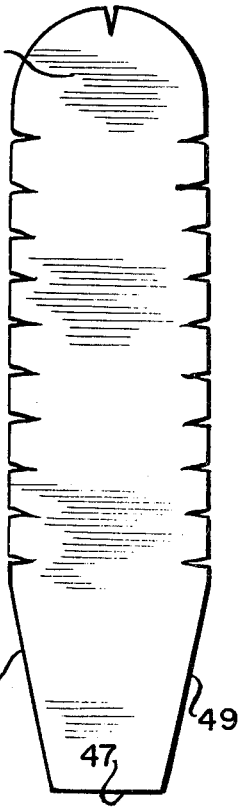
FIG. 9 is a plan view of the front portion of a finger of the glove of FIG. 1.
Figure 8:
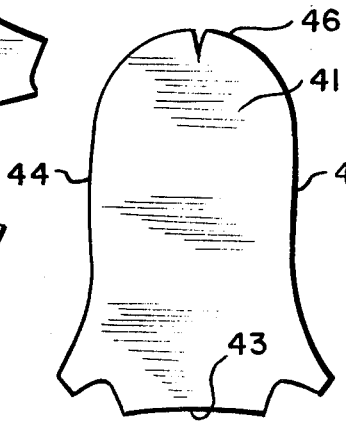
FIG. 8 is a plan view of the pattern of the back portion of a finger of the glove of FIG. 1.

The individual finger portions each comprise a front portion 41 as shown in FIG. 8 and a back portion 42 as shown in FIG. 9. Front portion 4 is stitched to the gauntlet along the bottom edge 43 and to the back portion 42 along the side edges 44 and 45 and top edge 46. The juncture between the front and back portions along the side edges 44 and 45 extends along a neutral line of the finger which may be referred to as a "line of non-extension." The back portion of each finger portion is joined to the gauntlet by stitching at the bottom edge 47 and to the back portion of adjacent finger portions along the side edges 48 and 49. The back portion of each finger portion is pleated across the width thereof by stitching as shown in FIG. 1 at pleats 50, 51, 52 and 53 so as to provide telescopic sections between the pleats in order that the fingers may be easily flexed. In this manner, the finger portions of the glove will conform to the normal finger movement of the wearer which when combined with the particular thumb construction provides a glove construction the parts of which will move in a natural manner to conform with the movement of the fingers and thumb of the wearer.

Preferably, the outer lining of the glove, including the gauntlet and all of the parts making up the finger and thumb portions comprise a natural leather material. As is known, leather has a property of breathing which contributes to the comfort of the wearer. In instances where the glove may be subjected to damp conditions, as for example when the glove is utilized as a ski glove, it is desirable that the glove lining also have a moisture impervious property so as to prevent moisture from entering the interior of the glove and contributing to the discomfort of the wearer. I treat the inner face of the leather which also happens to be the flesh side of the leather by spraying a heat sensitive acrylic urethane emulsion onto the surface and subjecting the surface so sprayed to heat and pressure. Some of the emulsion penetrates into the leather and some forms a thin elastic film on the order of 0.0005 inch thickness on the inner face. This film provides a moisture barrier, and being on the inner face of the lining, is not subject to abrasion. The outer face of the leather lining remains untreated and so preserves a natural appearance.

I claim:

1. A glove construction having a conformal thumb portion, said glove construction comprising a gauntlet portion adapted to fit the palm of the wearer and having an aperture therein for receiving a thumb of the wearer, a metacarpal thumb portion joined to said gauntlet portion around a part of the periphery of said aperture and adapted to engage the front of the thumb of the wearer extending along the thumb metacarpal bone, a first phalanx portion joined to said metacarpal portion and joined to said gauntlet portion along a part of the periphery of said aperture and adapted to engage the front of the thumb of the wearer along the first thumb phalanx, a second phalanx portion joined to said first phalanx portion and adapted to engage the front of the thumb of the wearer along the thumbnail portion, and a front thumb portion joined at one end to said gauntlet around a part of said aperture and at another end to said second phalanx portion.

2. A glove construction according to claim 1 having in addition a thumb abrasive portion overlapping a part of said thumb back portion and a part of said first and second phalanx portions.

3. A glove construction according to claim 1 wherein the connection between the metacarpal portion and the first phalanx portion corresponds with the first thumb joint of a wearer and the connection between the first and second phalanx portions corresponds with the second thumb joint of the wearer.

4. A glove construction according to claim 1 having in addition finger portions, each said finger portion having a back finger portion joined at one end to said gauntlet portion and a front finger portion joined at one end to said gauntlet portion and to said back finger portion at another end and along the sides thereof, said back portion having a plurality of pleats extending across the width thereof in an area adapted to extend adjacent the first and second phalanxes of the finger of the wearer.

5. A glove construction having an outer leather covering material and a water impermeable elastomer material firmly bonded to a major part of the inwardly facing surface of said covering material with a portion of said impermeable elastomer material penetrating into the covering material and a portion forming a thin film.

* * * * *